US006319545B1

(12) United States Patent
Laurent

(10) Patent No.: US 6,319,545 B1
(45) Date of Patent: Nov. 20, 2001

(54) METHOD FOR CONSTRUCTING A RESILIENT SURFACE

(76) Inventor: Lance Edward Laurent, 12511 Leavenworth Rd., Omaha, NE (US) 68154

( * ) Notice: Subject to any disclaimer, the term of this patent is extended or adjusted under 35 U.S.C. 154(b) by 0 days.

(21) Appl. No.: 09/503,824

(22) Filed: Feb. 15, 2000

(51) Int. Cl.[7] ..... E01C 13/00; B05D 1/12

(52) U.S. Cl. ..... 427/136; 427/188; 427/196; 427/214; 427/421; 427/426

(58) Field of Search ..... 427/136, 163.4, 427/180, 186, 196, 421, 426, 429, 188, 214

(56) References Cited

U.S. PATENT DOCUMENTS 3,168,411 * 2/1965 Walsh ..... 117/26
3,676,198 * 7/1972 McGroarty ..... 117/105.5
4,116,163 * 9/1978 Torelli et al. ..... 118/303
4,491,608 * 1/1985 Thygesen ..... 427/186
4,856,931 * 8/1989 Bollag ..... 404/75
5,472,743 * 12/1995 Daluise ..... 427/426
6,036,998 * 3/2000 Calvo et al. ..... 427/214

* cited by examiner

*Primary Examiner*—Shrive P. Beck
*Assistant Examiner*—Jennifer Calcagni
(74) *Attorney, Agent, or Firm*—Philip J. Lee

(57) ABSTRACT

A method of constructing a resilient surface layer of particles bound together and to a base surface comprises uniformly dropping dry rubber particles from a moving apparatus and spraying the particles with a liquid, water based, latex binder as the particles are dropping, the apparatus comprises a movable vehicle with a particulate spreading assembly comprising a hopper with a controlled orifice, and a spray system with an array of nozzles directed to intersect the path of the particles after leaving the hopper and before the particles reach the base surface.

13 Claims, 2 Drawing Sheets

METHOD FOR CONSTRUCTING A RESILIENT SURFACE

BACKGROUND OF THE INVENTION

A. Field of Invention

The present invention relates generally to construction of resilient surfaces and more particularly to a new and improved method of constructing resilient athletic surfaces and an apparatus for carrying out said method.

B. Description of Related Art

It has been known for some time that surfaces for the performance of athletic or similar activities are beneficially constructed with a coating of rubber particles bound by binding agents such as liquid latex material to result in a surface on which a variety of activities can take place. The resulting surface is resilient, impervious or resistant to damage by exposure to the elements, and has the capability of absorbing and draining off water without creating standing puddles. See, for example, U.S. Pat. Nos. 4,474,833 and 4,529,622, both of which are directed to a method of constructing an all-weather surface comprising essentially the steps of initially coating the surface with a tack-coat of hot asphaltic emulsion or other suitable liquid binder, followed by repetitive cycles of first spreading particulate rubber, and then spraying a liquid binding substance over the particulate rubber layer. After allowing the binder to dry, the spreading particulate and spraying binder steps are repeated until a sufficient thickness is obtained. The known method of constructing such surfaces is therefore time consuming and requires multiple pieces of machinery. The alternative methods of constructing such surfaces have been tried, specifically, mixing a slurry of rubber particulate with a liquid binder and spreading the pre-mixed slurry to the surface. This method, however, has been found to be cumbersome and difficult to apply with consistent results. The need is for a method of constructing particulate rubber surfaces in an economical and efficient operation and an apparatus for carrying out the method.

SUMMARY OF THE INVENTION

The present invention comprises a method of constructing a resilient, all-weather surface that combines the particulate dispersal and binder application steps into one operation. The method essentially comprises spreading particles by evenly dropping the particles from a spreader assembly and coating the particles with a liquid binder as they are falling toward the base surface. In the present invention, rubber particles, usually recycled from sources such as used tires, are used, although a variety of substances could be used with performance or binding characteristics varying according to the substitute materials used. The particles are small enough to produce as relatively smooth surface as is desired and sufficiently large and irregularly shaped that when coated with binder and dropped on a surface, the particles do not pack tightly together and significant interstitial spaces remain. The resulting surface is generally even but sufficiently irregular to provide traction to users. The resilience of the resulting surface is the result of both the inherent resilience of the particle material itself as well as the flexibility of the binder joining the particles at their contact points. The dry, uncoated particles are easily handled and may be spread over the surface by a variety of commercially available particulate matter spreaders, such as are used to spread fertilizer, seeds, or other agricultural products. As the particles are falling from the spreader, they are sprayed with a liquid binder material such as a mixture or emulsion of a suitable binding material such as latex and a solvent such as water. The method of the present invention may be performed by means of an apparatus which combines the particulate spreader assembly with a binder sprayer system. A commercially available spreader may be used to spread the particles in a uniform layer by controlling an even flow of particles from a hopper onto a conveyor belt. A hopper gate extends across the width of the belt to allow a controlled amount of particles to be deposited evenly across the width of the belt. The particles are conveyed by the belt to the rear of the apparatus where the belt passes over an end roller. In the illustrated preferred embodiment, a roller brush, rotating in the opposite direction, clockwise when viewed from the right side, from the end roller uniformly brushes the particles off the belt and toward the ground or base surface. The rubber particles are dropped at a uniform rate in a row from the spreader which is moved over the surface at a uniform rate. The spraying operation preferably is performed evenly and gently enough that a uniform layer of binder coated particles is spread.

The sprayer system for coating the particles with a liquid binding solution prior to the particles hitting the ground comprises a conventional power source, a source tank of liquid binder, double rows of upper spray nozzles and a lower spray nozzle, and tubing to connect the elements. Each row of upper spray nozzles comprises two nozzles, which are preferably designed to providing an even and cone like spray of liquid binder material. The spray nozzles are directed and positioned such that the spray cones of adjacent nozzles overlap slightly. The rows of upper spray nozzles are positioned serially above and behind the end roller and brush, with the upper spray nozzles directed downward and forward. The position and direction of the upper spray nozzles is such that the flow of particles is subjected to and must pass through a relatively continuous spray of liquid binder, between the conveyor belt to the base surface. A lower spray nozzle is positioned below the end roller and brush with a single spray nozzle directed upward and rearward. The spray of binder provided by the lower spray nozzle is generally in opposition to the spray provided by the upper spray nozzles, and the particles must pass through the spray of binder provided by the lower sprayer, on the way from the belt to the ground or base surface. Each of the spray nozzles in the preferred embodiment is a common nozzle with appropriately sized orifices for the viscosity of the liquid binder and available spray pressure. The spray pressure and nozzle direction are adjustable to accommodate different conditions and materials to accomplish a uniform and complete coating of the particulate by the liquid binder material before the particulate is deposited on the surface. Adjustments may also be required to avoid over or miss directed spray.

The rubber particle spreading assembly, comprising the hopper, conveyor belt system, and brush roller, is integrated with the sprayer system comprising the power source and array of nozzle heads with associated tubing. The integrated apparatus is mobile and may be self propelled or configured as a trailer to be pulled behind a tractor.

The method of the present invention utilizes the described apparatus to deposit a uniform layer of binder coated particles, preferably rubber, for each pass of the apparatus over a base surface, without need for significant raking of loose particles or separate spraying of the loose particles. Multiple passes are made as needed to achieve the desired thickness of surface material. The method of the present invention assumes that adequate surface preparation has been accomplished before the deposition of a layer of binder coated particulate by this method. The method may be applied to resurface existing tracks or other surfaces without significant advance preparation, providing the surface is as flat and level as will be desired. Since both sides of the particles are sprayed and coated with binder, it is not necessary to use an initial tack coating on the surface to ensure adherence of the particles to the surface. As currently practiced, the method of the present invention includes a final, top coat of latex with materials added to provide protection from ultraviolet light. Either the tack coat or the top coat, or both could be added to the operation without requiring a modification of the method.

The principal aim of the present invention is to provide a new and improved method of applying a particulate rubber surfacing material which meets the foregoing requirements and which is capable of being applied in a single pass operation.

Another and further object and aim of the present invention is to provide a new and improved device for applying to a flat surface a particulate rubber surfacing material coated with a liquid binder which meets the foregoing requirements.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the appended claims.

DESCRIPTION OF THE PREFERRED EMBODIMENT(S)

Figure 1:
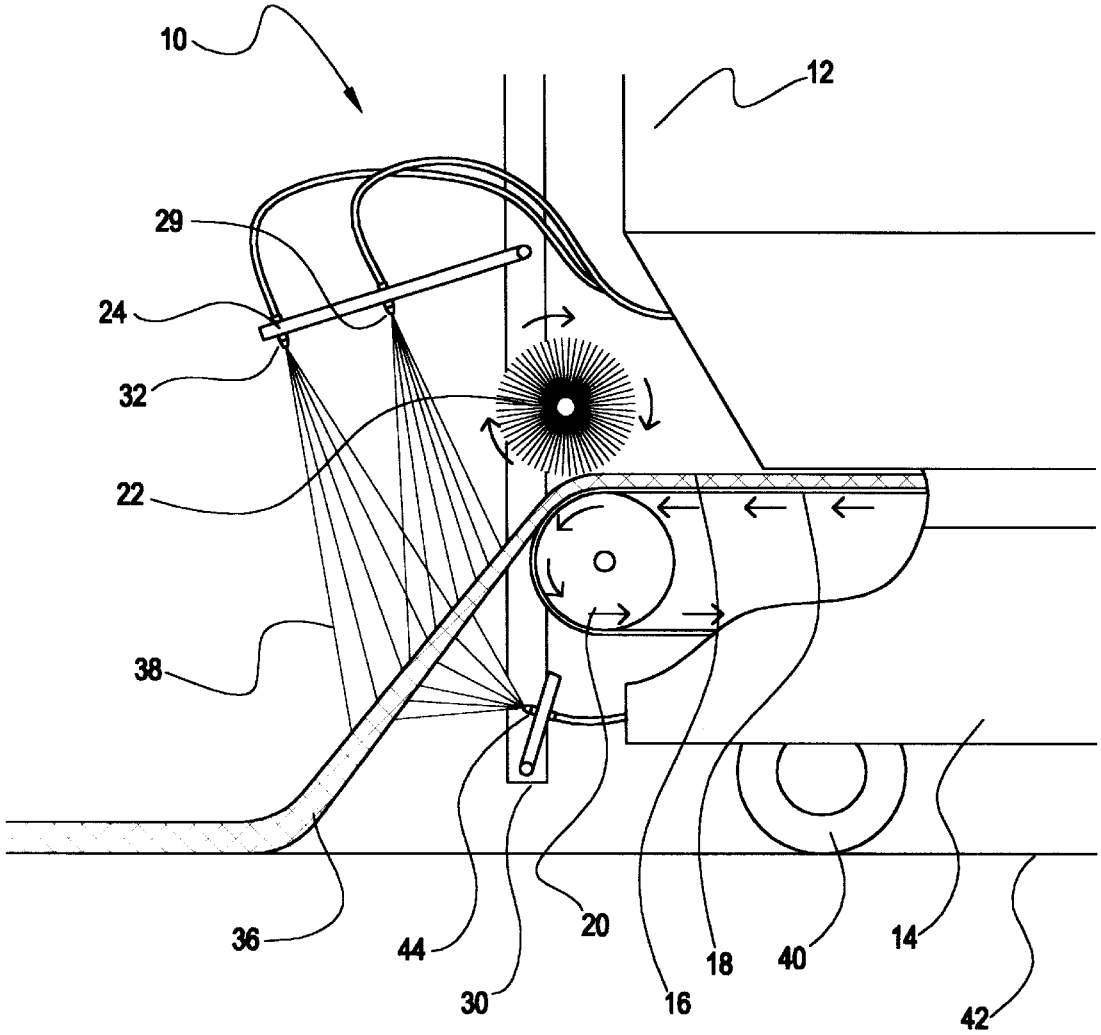
FIG. 1 is a side view of a preferred embodiment of the invention showing the apparatus of the present invention mounted on a wheeled chassis.
Figure 2:
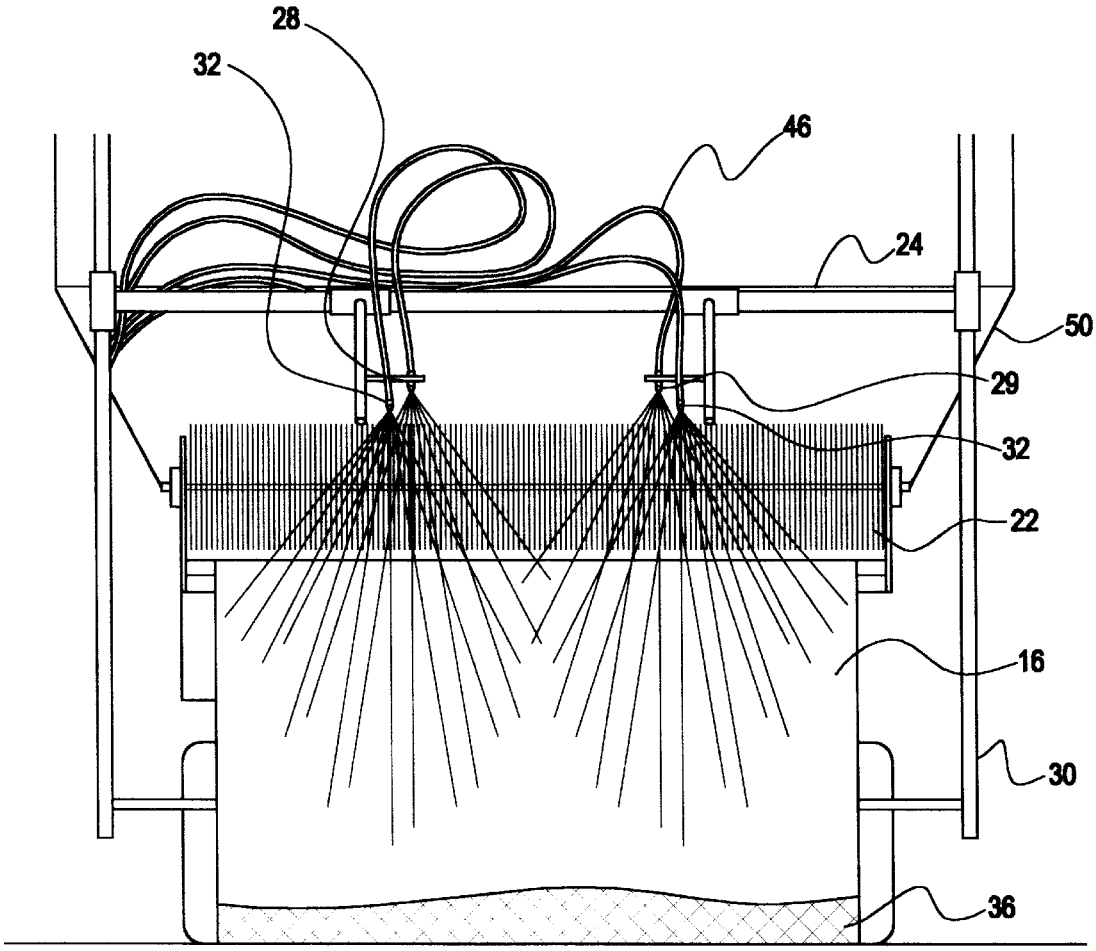
FIG. 2 is an end view of a preferred embodiment of the invention showing the apparatus of the present invention mounted on a wheeled chassis.

With reference to the Drawings wherein like numerals represent like parts throughout the Figures, a preferred embodiment of the apparatus for carrying out the method of the present invention is generally designated by numeral 10 in FIGS. 1, and 2. For the sake of clarity and ease of reference herein, apparatus 10 is referred to as being deployed over a horizontal base surface 42, as it would normally be so deployed. As will be appreciated from the description which follows, the term base surface 42 refers to the original surface on which the resilient surface will be installed as well as the top of the last layer of coated particles to be spread. Further, apparatus 10 is referred to as having a top and a bottom and the terms "up", "upper", "upward" or "top" mean the direction or portion of the apparatus that is away from the base surface 42 and the terms "down", "lower", "downward" or "bottom" mean the direction or portion of the apparatus that is toward the base surface 42. The use of these directional conventions are intended merely as exemplars and not as a limitation of the use of the apparatus 10 which can be used in other directional orientations.

The method of the present invention comprises coating particles with a liquid binder and evenly distributing the coated rubber particles over a base surface. In the Figures, the base surface on which the particles are to be deposited is designated by the numeral 42 and constitutes the surface upon which a course of binder coated particulate is to be spread. Uncoated particles are shown in the Figures as light dots and designated by the numeral 16, and coated particles are shown in the Figures as heavy dots and designated by the numeral 36. Sprays of liquid binder are shown in the Figures as series of dashed lines and designated by the numeral 38. In the method of the present invention the first step is to drop the uncoated particles 16 toward the base surface 42 from a particle spreader assembly 26 mounted on apparatus 10. The second step of the method comprises coating the particles 16 with liquid binder substance as they are falling toward the base surface 42, that is, after leaving the particle spreading assembly 26 and before reaching the base surface 42. To ensure even coating of the particles, the stream of falling particles 16 is sprayed on top and on bottom by opposing sprays 38 of a liquified binding material.

In the illustrated preferred embodiment, the particles 16 are formed of butadiene-styrene rubber (SBR) or ethylene-propylene terpolymer (EPDM) and are often derived from the recycling of used automobile tires, industrial waste or similar sources, such material being readily available and having the desirable characteristics of being durable, resilient, relatively impervious to exposure to the elements and providing traction for users of the resulting surface. It will be anticipated that other suitable particulate materials may be substituted, such as vinyl, for the preferred substances with performance changes corresponding to the differences in desirable characteristics. As an example and not a limitation, it is noted that for use in refinishing athletic tracks, particles in the range of 1 to 3 millimeters are generally preferred, with particles from 0.5 millimeters to 5 millimeters being tolerated and sometimes preferred. Particle shape in most applications is not important as it is frequently preferred that interstitial spaces remain between the deposited particles. In the illustrated preferred embodiment, the liquid binder substance is selected for flexibly binding the particulate and a mixture or emulsion of latex resin in water is used with the preferred rubber particles. The term "latex" is used herein to refer to a butadiene-styrene resin emulsion in an aqueous base. Other possible binders are known in the field and include emulsions of acrylic latexes. Other materials or additives may be used to provide desired color or other properties such as resistance to the effects of ultraviolet light. As an example only, a mixture of water based resins sold by Calif. Products Corporation of Cambridge Mass. under the registered Trademark Plexitrac® has been found to be useful in the construction of athletic tracks.

The preferred method of distributing the rubber particles over the surface 42 is by means of one of a variety of commercially available particulate matter spreaders, such as are used to spread fertilizer, seeds, or other agricultural products. As an example of an acceptable particulate spreader, and not as a limitation of the invention, an exemplar apparatus 10 has been constructed using the spreading assembly 26 of the Mete-R-Matic® III Top Dresser, Registered Trademark of Turfco Mfg. Inc., Minneapolis Minn. The spraying operation preferably is performed by an air pressure driven spray system the bulk of which is not shown as spray equipment of this type is readily commercially available. As an example only, and not as a limitation, a 5.5 horsepower air compressor powering an air driven 1¼ inch diaphragm pump with a surge dampener has been recommended by a manufacturer of suitable liquid binder as an appropriate means for spraying the binder.

The method of the present invention may be performed by means of an apparatus 10 which combines the particle spreader assembly 26 with a sprayer system. The illustrated preferred embodiment of the particle spreader assembly 26 of apparatus 10 meters an even flow of particles 16 from a raised hopper 12 onto a conveyor belt 18 running over and between a front roller (not shown) and a rear end roller 20. In operation, the top surface of the conveyor belt 18 proceeds toward the rear of apparatus 10. An adjustable hopper gate (not shown) extends across the width of the belt 18 to allow a controlled amount of dry rubber particles 16 to exit the hopper 12 onto the top surface of belt 18, evenly across the width thereof. The rubber particles 16 are conveyed by the belt 18 to the rear of the apparatus 10 where the belt 18 passes over rear end roller 20 which is rotatable about a horizontal axis in a counter-clockwise direction, when viewed from the right side 50 of apparatus 10. In the illustrated preferred embodiment, a roller brush 22 is mounted on an axis parallel to the axis of rear end roller 20 and is rotatable, in a counter-clockwise direction, when viewed from the right side 50 of apparatus 10. In operation of apparatus 10, roller brush 22 uniformly brushes the rubber particles 16 off the belt 18 and toward the ground surface 42. The rear end roller 20 and brush 22 are generally parallel and transverse to the direction of travel of the apparatus 10, and particles drop from the belt 18 in a line transverse to the direction of travel of apparatus 10.

The sprayer system for coating the dry rubber particles 16 with liquid binding solution comprises four upper nozzle heads 28, 29, 31, and 32, and a lower nozzle head 44. Upper nozzle heads 28 and 29 are arrayed in a row parallel to the axis of rear end roller 20 and roller brush 22, and are positioned above and behind the rear end roller 20 and roller brush 22. Upper nozzle heads 31 and 32 are similarly arrayed in a row parallel to and lower and more rearward than heads 28 and 29. All of the upper nozzle heads 28, 29, 31, and 32 are directed downward and forward to project a spray 38 of liquid binder material intersecting the path of falling dry rubber particles 16 after they drop from roller 20. The binder 38 sprayed from the upper nozzle heads 28, 29, 31, and 32 slightly overlaps to provide a relatively even and continuous spray 38 across the width of the particle flow path. Lower spray nozzle 44 is positioned below the rear end roller 20 and roller brush 22, and is directed upward and rearward toward the under side of the rubber particles dropping from roller 20, generally in opposition to the spray 38 provided by the upper spray nozzles 28, 29, 31, and 32. Each of the nozzles 28, 29, 31, 32, and 44 in the preferred embodiment is a common nozzle with appropriately sized orifices for the viscosity of the liquid binder and available spray pressure.

The entire rubber particle distribution assembly of apparatus 10, comprising the hopper 12, the conveyor belt 18 and its rollers and drive mechanism (not shown), and brush roller 22, is integrated with the entire sprayer apparatus comprising the upper and lower spray nozzles 28, 29, 31, 32, and 44 with associated tubing 46 as well as a reservoir of liquid binder and air compressor (not shown). The integrated apparatus 10 is mobile and comprises at least one set of wheels 40. A body 14 generally encloses part of apparatus 10 and vertical support brackets 30 support the lower spray nozzle 44 and support bars 24 on which upper spray nozzles 28, 29, 31, and 32 are mounted. Apparatus 10 may be self propelled or configured as a trailer to be pulled behind a tractor (not shown).

In operation apparatus 10 is used to carry out the method of the present invention by setting apparatus 10 in motion and keeping apparatus moving at a uniform rate of speed over the surface 42 to be coated. As apparatus 10 is moving over surface 42, the particle distribution assembly 26 is started by opening the hopper gate by a predetermined amount to commence the flow of dry, uncoated particles 16 and belt 18 is started to carry the particles 16 to the end roller 20 from which particles 16 are dropped toward the surface 42 at a uniform rate. At the same time as uncoated particles 16 begin to drop from end roller 20, the binder spray system is started such that the particles 16 that drop to the surface 42 fall through the binder spray 38 and are coated with binder before reaching the surface 42. A swath comprising a uniform depth of liquid binder coated particles 36 is thereby deposited on surface 42. After the liquid binder dries sufficiently to allow travel over the resulting surface, the process may be repeated as described above, with as many repetitions as are necessary to achieve the desired total depth of material. It may be found beneficial to add to the foregoing described basic method by initially applying a tack coat of a liquid binder and to apply a final, top coat of latex binder with materials added to provide protection from ultraviolet light. These additional steps are expected to provide benefits of surface adhesion and durability.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention. In particular, it will be anticipated that a variety of configurations can serve the function of the spray assemblies and nozzles. It will be further anticipated that alternate means of particulate handling may be employed with similar results, provided the deposition on the surface is adequately uniform. It will be further anticipated that although the method and apparatus of the present invention can be beneficially applied to the construction or refurbishing of athletic tracks and performance surfaces, such applications are examples and not limitations of use.

What is claimed is:

1. A method of constructing a resilient surface comprising particles of resilient material bound together and to a stationary base surface by a liquid binder, the method comprising the steps of, first, dropping particles of resilient material from an apparatus moving relative to the base surface, the particles falling in a line transverse to the direction of movement of the apparatus and substantially the width of the apparatus, toward the base surface and second, coating the particles with a liquid binder by spraying the uncoated particles with liquid binder after the particles are dropped toward the base surface from the apparatus and before the particles reach the base surface, without otherwise manipulating the particles while falling from the apparatus to the base surface.

2. The method of claim 1 wherein the particles are dropped at a uniform rate from the apparatus as the apparatus is moved over the base surface at a uniform rate.

3. The method of claim 2 further comprising a plurality of successive repetitions of the steps of distributing particles over a surface and coating the particles with a liquid binder before the particles reach the surface, over the same surface until the desired thickness of the resilient surface layer is achieved.

4. The method of claim 3 wherein the particles are formed of rubber.

5. The method of claim 4 wherein the liquid binder is an emulsion of latex in a water base.

6. The method of claim 5 wherein the spray of the liquid binder is directed toward the particles from at least two directions.

7. The method of claim 6 wherein the particles range in size from about 0.5 millimeters to about 5 millimeters.

8. A method of constructing a resilient surface comprising particles of resilient material bound together and to a stationary base surface, the method comprising the step of evenly distributing resilient particles over the base surface from an apparatus moving at a uniform rate relative to the base surface, the particles falling to the base surface at a uniform rate in a line transverse to the path of the apparatus, and being coated with liquid binder after being released from the apparatus, without otherwise manipulating the particles while falling from the apparatus to the base surface.

9. The method of claim 8 wherein the particles are coated with liquid binder after being released from the apparatus.

10. The method of claim 9 further comprising a plurality of successive repetitions of the step of distributing resilient particles that are coated with a liquid binder evenly over the base surface, over the same surface until the desired thickness of the resilient surface layer is achieved.

11. The method of claim 10 wherein the particles are formed of rubber ranging in size from about 0.5 millimeters to about 5 millimeters and the liquid binder is an emulsion of latex in a water base.

12. The method of claim 11 wherein the uncoated particles are sprayed with liquid binder from at least two directions after the particles are dropped from the apparatus toward the base surface and before the particles reach the base surface.

13. The method of claim 12 wherein the step of distributing the particles further comprises the steps of dispensing the uncoated particles from a source at a controlled rate across the surface of a conveyance and rotating the conveyance with uncoated particles toward a point at which the conveyance is inverted, dropping the uncoated particles toward the base surface before the uncoated particles are sprayed with binder.

* * * * *